United States Patent [19]

Hartman et al.

[11] 4,098,031

[45] Jul. 4, 1978

[54] METHOD FOR LAPPING SEMICONDUCTOR MATERIAL

[75] Inventors: Robert Louis Hartman, Warren Township, Somerset County; Wilbur Dexter Johnston, Jr., Holmdel, both of N.J.

[73] Assignee: Bell Telephone Laboratories, Incorporated, Murray Hill, N.J.

[21] Appl. No.: 762,444

[22] Filed: Jan. 26, 1977

[51] Int. Cl.[2] ..... B24B 1/00; B24B 41/06

[52] U.S. Cl. ..... 51/323; 51/216 LP; 51/277; 51/281 SF; 51/283 R

[58] Field of Search ..... 51/216 LP, 277, 281 SF, 51/283, 326, 323

[56] References Cited

U.S. PATENT DOCUMENTS

| | | | |
|---|---|---|---|
| 3,041,800 | 7/1962 | Heisel | 51/277 |
| 3,475,867 | 11/1969 | Walsh | 51/277 X |
| 3,841,031 | 10/1974 | Walsh | 51/283 |
| 3,874,129 | 4/1975 | Deckert | 51/326 X |

OTHER PUBLICATIONS

Applied Physics Letter, vol. 23, p. 147, Aug. 1973, (Hartman).

Applied Physics Letter, vol. 24, p. 494, May 1974, (Johnston).

Applied Physics Letter, vol. 28, p. 140, Feb. 1966, (Logan).

Journal of Applied Physics, vol. 45, p. 3899, Sep. 1974, (Petroff).

*Primary Examiner*—Gary L. Smith

*Attorney, Agent, or Firm*—Michael J. Urbano

[57] ABSTRACT

It has been discovered that plastic deformation of a wafer of light-emitting semiconductor material during processing creates areas of poor radiative efficiency known as large dark spot (LDS) defects. An improved technique for lapping is described which alleviates stress and substantially reduces the initiation and propagation of such defects. Conventionally, wafers are affixed to a mounting plate by coating the plate with wax or some other appropriate adhesive and then applying pressure. The improvement comprises interposing a spacer between the mounting plate and the wafer. The spacer is capable of accommodating surface irregularities and particulates while maintaining substrate planarity.

2 Claims, 2 Drawing Figures

METHOD FOR LAPPING SEMICONDUCTOR MATERIAL

BACKGROUND OF THE INVENTION

1. Field of the Invention

The invention relates to an improved method of removing material from semiconductor bodies by lapping. The improvement is particularly applicable to the processing of a semiconductor material for devices in which the lifetime of minority carriers is of importance; for example, light emitting diodes, laser diodes, and solar cells.

2. Description of the Prior Art

An essential step in the production of many semiconductor devices is lapping the wafer to the desired thickness and smoothness. In the context of this application, "lapping" will be generic to both thinning and polishing. Thinning, inter alia, reduces the size and weight of the wafer (of importance for space solar cell applications and facilitates mirror cleavage (of importance for laser diode fabrication). Polishing removes work damage and improves surface quality.

For thinning, a mechanical abrasive lapping agent such as diamond paste or a chemical-mechanical abrasive such as Syton (Trademark of Monsanto Company) is generally used in conjunction with a rotatable lapping turntable. The device side of a wafer is bonded to a planar mounting plate by applying a suitable adhesive such as wax to the mounting plate and then pressing the wafer against the plate and adhesive. The mounting plate is placed within a lapping fixture adapted to hold the other side of the wafer (i.e., the substrate) against the rotating turntable. The translational motion between the wafer and the abrasive on the turntable causes the substrate side of the wafer to be ground down to the desired thickness and planarity. The wafer is usually polished to repair surface damage caused by the abrasive. For polishing, a chemical etchant soaked lapping pad is frequently used. Alternatively, the thinning could also be done using an etchant soaked pad instead of an abrasive on the turntable.

Although these lapping procedures are important to device fabrication, they may have deleterious effects on the device, particularly the occurrence of areas of poor radiative efficiency called large dark spot (LDS) defects. LDS are a major factor in reducing the yield of light emitting devices, e.g., $Al_1Ga_{1-X}As$-GaAs double heterostructure laser diodes. These LDS can also be nucleation sites for the growth of dark line defects (DLD) which significantly shorten the operating lifetime of such devices.

Photoluminescence studies have revealed that there are some LDS present in the as-grown wafer, but electroluminescence studies of completed devices have shown a proliferation of LDS following device processing, such as the lapping techniques described above. LDS result in regions of non-luminescent material because of significantly reduced minority carrier lifetime, and devices having one or more LDS within their active region do not operate optimally.

Inasmuch as LDS have been observed in p-n junction active heterostructure devices of direct bandgap materials, prevention of LDS would improve the quality and operating lifetime not only of lasers, but also LEDs, photodiodes, solar photovoltaic cells, phototransistors, photodetectors, etc., all of which depend for their efficient operation on good minority carrier lifetime and freedom from excessive non-radiative recombination of minority carriers such as occurs in the LDS defects.

Several theories have been proposed to explain the nature of the recombination process associated with LDS defects. Johnston, *Applied Physics Letters,* Vol. 28, (1976), p. 140, has suggested that LDS are the result of strain induced nonradiative heterointerface states, i.e., that nonradiative recombination is enhanced by the presence of a strain gradient. Another theory by C. H. Henry suggests that damage, such as microcracks, extending into the active region siphons off normal diffusion current into space-charge recombination causing excess junction current.

Johnston, *Applied Physics Letters,* Vol. 24, (1974), p. 494, suggested that LDS were produced by elastic strain fields associated with microscopic physical damage. R. L. Hartman and A. R. Hartman, *Applied Physics Letters,* Vol. 23, (1973), p. 147, proposed that strain fields can be responsible for shortening the operating lifetime of laser diodes. Accordingly, a modified bonding procedure was suggested which alleviated stress created by the different thermal expansion coefficients of the diode, bonding material and header. P. Petroff and R. L. Hartman, *Journal of Applied Physics,* Vol. 45, (1974), p. 3899, suggested that perturbations of the crystal lattice could be nucleation sites for the growth of DLD which shorten device lifetime in laser diodes. Physically damaged regions of a crystal indicated by LDS can be such nucleation sites, partly responsible for premature failure. Johnston in *Applied Physics Letters,* Vol. 24, supra, pointed out that LDS were caused by stresses during processing from contact of the wafer with hard surfaces. Avoidance of hard materials during lapping was suggested to alleviate the problem.

Although the prior art indicates that avoidance of hardness during processing will alleviate the LDS problem, typical means of doing so create additional problems. For example, both a soft lap or a soft mounting plate will cause loss of substrate planarity. A soft lap refers to the hardness of the lapping turntable or the lapping agent with respect to the wafer. It is known in the art that a soft lap causes less work damage than a hard lap, but causes rounding of the wafer. A mounting plate soft enough to alleviate the stresses causing LDS would also cause lack of planarity. Planarity requires that the wafer be mounted and held without distortion during the lapping procedures. Typical candidates for a mounting plate intended to have a quality intermediate between "soft" (such as pitch) and "hard" (such as steel) would be soft rubber, plastic, or Teflon (Trademark of Du Pont). These are neither soft enough to prevent LDS formation nor hard enough to preserve planarity so that such compromise candidates are doubly unacceptable.

SUMMARY OF THE INVENTION

We have discovered an improved lapping technique which not only substantially reduces the initiation and propagation of LDS but permits the use of a hard lap so that excellent planarity is retained. We believe LDS are created by high local stress on the wafer caused by surface imperfections or particulates which can act as point stresses when the wafer is bonded to the mounting plate by the prior art technique, i.e., pressure against a hard flat mounting plate. In accordance with one aspect of the invention, these localized stresses can be alleviated by the interposition of a spacer between the mounting plate and the wafer. The spacer is a fibrous material which is capable of accommodating surface irregularities or particulates in order to prevent them from contacting the mounting plate. The thickness of the spacer should be essentially uniform to preserve planarity, and should be sufficient to accommodate the expected height of imperfections yet thin enough to allow tight control of the wafer within the lapping fixture. It is also advantageous for the spacer to penetrable by the mounting adhesive, and for the fibers to be arranged in a somewhat random, irregular pattern.

DETAILED DESCRIPTION

The improved technique is applicable to the processing of any semiconductor wafers in which chemical or mechanical removal of material is required subsequent to growth. It can be easily instituted in any existing procedure and has proven to be effective in preventing the extension of existing LDS defects and the proliferation of new ones.

As-grown $Al_xGa_{1-x}As$ double heterostructure wafers were photoexcited by a krypton ion laser beam. The fluorescence emitted was filtered so that only the infrared emission from the active region was transmitted to an infrared microscope. At low photoexcitation levels, LDS appear as nonluminescent areas of approximately 100 micrometer size extending from a nonradiative central core. At higher photoexcitation levels, when the electron-hole recombination rate approaches that of laser operation, the luminescent area contracts to approximately 10–20 micrometers from the central core. Identical photoluminescent effects are observed when slight plastic deformation, such as a depression from a sharp instrument, is introduced into the device side of the wafer. Similar results are not observed for severe plastic deformation of the substrate surface. Photoluminescent studies of the same $Al_xGa_{1-x}As$ wafers subsequent to standard lapping and polishing procedures revealed moderate to severe proliferation of LDS. Irregularities on the as-grown surface and particulates can act to cause point stresses which induce slight plastic deformation of the surface when the wafer is pressed against a hard planar surface. The improved technique to be described below substantially reduces proliferation or creation of LDS during lapping procedures.

Figure 1:
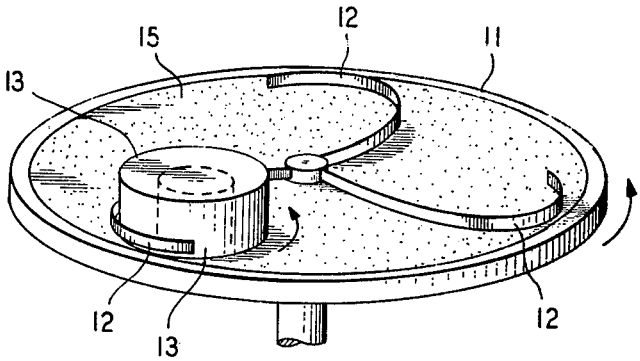
FIG. 1 shows an illustrative lapping apparatus.
Figure 2:
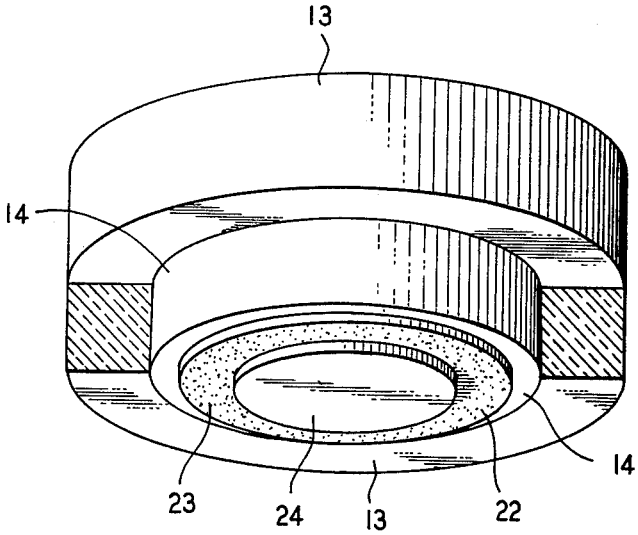
FIG. 2 illustrates a wafer bonded to a mounting plate with a spacer in accordance with one aspect of our invention.

FIG. 1 shows an illustrative lapping apparatus. Lapping fixture 13 is held in place by curved arms 12 against centrifugal forces created by rotation of lapping turntable 11. As shown in FIG. 2, mounting plate 14 is inserted into lapping fixture 13. Lapping fixture 13 is adapted to control the pressure on the wafer by well known techniques such as weights or a plunger and compression spring. The pressure may be varied to regulate the amount of material removed from the wafer 24 by friction from a lapping agent which is placed on lapping turntable 11, e.g., chemical etchant soaked polishing cloth 15 or a suitable mechanical abrasive.

FIG. 2 shows an enlarged view of a mounting plate 14 which is generally made from quartz or pyrex. In the prior art, an adhesive such as glycol phthalate or bees wax would be applied to mounting plate 14 and wafer 24 would be pressed down onto the adhesive, so that the device side of wafer 24 contacted mounting plate 14 and the substrate side of wafer 24 was exposed to lapping action. In accordance with our invention, however, a spacer 22 is interposed between wafer 24 and mounting plate 14. Spacer 22 comprises any soft, fibrous, material which is capable of deforming to accommodate surface imperfections. The diameter of the fibers should be comparable to or smaller than the expected width of a projection, whereas the thickness of the spacer should be sufficient to keep surface irregularities and particulates from contacting mounting plate 14 to act as point stresses when wafer 24 is pressed against plate 14. In addition, spacer 22 should be of substantially uniform thickness so that the planarity of the wafer will be retained during lapping. For example, the thickness of spacer 22 should be greater than 4 micrometers to allow at least for dust particles which are on the order of a few micrometers in height and a fiber diameter of about 3 micrometers will accommodate surface projections of typical width 20 micrometers.

Advantageously the fibers should not be woven in a regular manner, but in a somewhat random irregular pattern to permit better accommodation of imperfections. The spacer should also be porous so that an adhesive can penetrate through it to the mounting plate and the wafer. Thus, both spacer and wafer adhere well enough to mounting plate 21 to permit accurate control of wafer 24 within lapping fixture 13 of FIG. 1.

EXAMPLE I

Using the foregoing technique, we processed wafers of double hetero structure laser material of the following composition: $A1_{0.36}Ga_{0.64}As$ p-type cladding, $A1_{0.1}Ga_{0.9}As$ p-type active region, $Al_{0.36}Ga_{0.64}As$ n-type cladding and an n-type GaAs substrate.

Referring to FIG. 2, the p-type $Al_{0.36}Ga_{0.64}As$ epi-surface of wafer 24 and spacer 22 of oridinary lens paper (10–12 micrometers thick with a fiber diameter of about 3 micrometers), were affixed to mounting plate 14 with glycol phthalate 23. Lens paper 22 is porous and molten glycol phthalate can penetrate through it to the wafer when pressure and heat are applied during mounting. Mounting plate 14 was then inserted in lapping fixture 13. 3–5 micrometer alumina abrasive was placed on lapping pad 15 and pressure was applied from lapping fixture 13 to remove material from the n-type substrate of the laser wafer as lapping turntable 11 was rotated. This procedure thinned the wafer. Following thinning, the alumina was replaced by a bromine-methanol soaked lapping pad, the amount of pressure applied by lapping fixture B was reduced, and the wafer was polished to remove work damage. Before lapping, a typical wafer had dimensions in the plane of the wafer on the order of a few centimeters and a thickness between 0.25 to 0.5 millimeters. Lapping removed 0.15 to 0.4 millimeters of material to produce a final thickness of approximately 0.1 millimeter. The required planarity across the wafer is typically an order of magnitude smaller than the final wafer thickness. Photoluminescent studies of the finished wafers revealed no new LDS. In contrast, identical material processed exactly in this fashion but with omission of spacer 22 showed proliferation of LDS defects at a typical density of 100 per $cm^2$.

What is claimed is:

1. A method of lapping a wafer of semiconductor material in a manner to substantially reduce the initiation or propagation of stress induced defects, said method being carried out in an apparatus which includes a rotatable lapping turntable, a mounting plate to which said wafer is removably secured, said wafer being positioned in contact with said lapping turntable, and means for moving said lapping turntable relative to said mounting plate, said method being characterized by the steps of:

(a) placing a spacer on said mounting plate, said spacer being of a soft fibrous material of substantially uniform thickness sufficient to deform around irregularities and particulates on the surface of said material and to prevent said irregularities and particulates from contacting the surface of said mounting plate;

(b) securing said wafer and said spacer to said mounting plate;

(c) applying a layer of abrasive material to said lapping plate;

(d) moving said lapping plate relative to said mounting plate thereby to thin said wafer;

(e) removing said abrasive from said lapping plate;

(f) placing a chemical etchant soaked polishing pad on said lapping plate; and (g) moving said lapping plate relative to said mounting plate thereby to polish said wafer.

2. A method for lapping a semiconductor wafer including a GaAs substrate on one side and a device region on the other side without introducing strain induced defects or areas of poor radiative efficiency in the device region, said method being performed with an apparatus which includes a rotatable lapping turntable, a mounting plate to which said device region of said wafer is removably bonded, said substrate being positioned in contact with said lapping turntable, and means for moving said lapping turntable relative to said mounting plate, said method being characterized by the steps of:

(a) bonding a spacer of lens paper to said mounting plate with glycol phthalate;

(b) bonding said device region of said wafer to said mounting plate and said spacer with glycol phthalate;

(c) placing 3–5 micrometer alumina abrasive on said lapping plate;

(d) applying pressure to said mounting plate;

(e) moving said lapping plate relative to said mounting plate, thereby to thin said wafer;

(f) replacing said abrasive with a bromine-methanol soaked pad;

(g) applying less pressure to said mounting plate than in step (d); and (h) moving said lapping plate relative to said mounting plate, thereby to polish said wafer.

* * * * *